US010143984B2

(12) United States Patent
Krom, Jr. et al.

(10) Patent No.: US 10,143,984 B2
(45) Date of Patent: Dec. 4, 2018

(54) METHOD AND APPARATUS FOR DISPENSING LIQUIDS FROM A PLURALITY OF CARTRIDGES

(75) Inventors: Ronald Peter Krom, Jr., HC Katwijk (NL); Goran Aleksijovski, HX Noordwijk (NL); Johannes Hermanus Nicolaas Post, NM Sassenheim (NL)

(73) Assignee: FAST & FLUID MANAGEMENT B.V., Sassenheim (NL)

( * ) Notice: Subject to any disclaimer, the term of this patent is extended or adjusted under 35 U.S.C. 154(b) by 0 days.

(21) Appl. No.: 13/073,310

(22) Filed: Mar. 28, 2011

(65) Prior Publication Data

US 2012/0248147 A1 Oct. 4, 2012

(51) Int. Cl.

| | |
|---|---|
| ***B67D 7/06*** | (2010.01) |
| ***B01F 13/10*** | (2006.01) |
| ***B01F 9/00*** | (2006.01) |
| ***B01F 9/06*** | (2006.01) |
| ***B01F 15/00*** | (2006.01) |
| ***B01F 15/04*** | (2006.01) |

(52) U.S. Cl.

CPC ..... *B01F 13/1058* (2013.01); *B01F 9/0021* (2013.01); *B01F 9/06* (2013.01); *B01F 13/1066* (2013.01); *B01F 13/1069* (2013.01); *B01F 15/00194* (2013.01); *B01F 15/00253* (2013.01); *B01F 15/0445* (2013.01)

(58) Field of Classification Search

CPC ..... B01F 9/0021; B01F 9/06; B01F 13/1058; B01F 13/1069; B01F 13/1066; B01F 15/0445; B01F 15/00194; B01F 15/00253

USPC ..... 222/135, 144, 63, 113, 212, 214, 144.5; 422/562; 436/180, 46

See application file for complete search history.

(56) References Cited

U.S. PATENT DOCUMENTS

| | | | | |
|---|---|---|---|---|
| 2,094,702 A | | 4/1936 | Hexter | |
| 4,827,993 A | | 5/1989 | Ito | |
| 4,976,137 A | | 12/1990 | Decker | |
| 5,396,316 A | * | 3/1995 | Smith | 399/120 |
| 5,711,458 A | * | 1/1998 | Langeveld et al. | 222/144 |
| 6,003,731 A | * | 12/1999 | Post et al. | 222/135 |
| 6,092,695 A | * | 7/2000 | Loeffler | 222/207 |
| 6,180,061 B1 | * | 1/2001 | Bogen et al. | 422/64 |

(Continued)

FOREIGN PATENT DOCUMENTS

| | | |
|---|---|---|
| EP | 0800858 A1 | 10/1997 |
| EP | 1090679 A1 | 4/2001 |

(Continued)

OTHER PUBLICATIONS

Description Translation for already cited EP Patent 2135668.*

(Continued)

*Primary Examiner* — Nicholas J Weiss

(74) *Attorney, Agent, or Firm* — Tucker Ellis LLP; Heather M. Barnes; Michael G. Craig

(57) ABSTRACT

An apparatus for dispensing a plurality of liquids, in particular colorants for paints, comprising a support, such as a turntable or a linear table, defining a plurality of positions and a plurality of containers holding a liquid, mounted on the support at the positions, and provided with a pump and/or a valve for dispensing the liquid from the container. At least some of the containers form, together with a respective liquid and pump and/or valve, a cartridge, which cartridge is releasably mounted in the apparatus.

20 Claims, 1 Drawing Sheet

(56) References Cited

U.S. PATENT DOCUMENTS

| | | | | |
|---|---|---|---|---|
| 6,244,474 | B1 * | 6/2001 | Loeffler | 222/207 |
| 6,273,298 | B1 * | 8/2001 | Post | 222/105 |
| 6,615,881 | B2 * | 9/2003 | Bartholomew et al. | 141/18 |
| D485,310 | S * | 1/2004 | Bartholomew et al. | D20/4 |
| 6,672,341 | B2 * | 1/2004 | Bartholomew et al. | 141/18 |
| D500,804 | S * | 1/2005 | Bartholomew et al. | D20/4 |
| 6,883,561 | B2 * | 4/2005 | Bartholomew et al. | 141/18 |
| 6,935,386 | B2 * | 8/2005 | Miller et al. | 141/18 |
| 6,945,431 | B2 * | 9/2005 | Miller | 222/144 |
| D513,040 | S * | 12/2005 | Bartholomew et al. | D20/4 |
| 7,082,970 | B2 * | 8/2006 | Bartholomew et al. | 141/104 |
| 7,099,740 | B2 * | 8/2006 | Bartholomew et al. | 700/231 |
| 7,185,789 | B2 * | 3/2007 | Mink et al. | 222/135 |
| 7,360,564 | B2 * | 4/2008 | Engels et al. | 141/83 |
| 7,475,710 | B2 * | 1/2009 | Bartholomew et al. | 141/104 |
| 7,501,283 | B2 * | 3/2009 | Hersch et al. | 436/46 |
| 7,624,769 | B2 * | 12/2009 | Bartholomew et al. | 141/2 |
| 7,644,840 | B2 * | 1/2010 | Held et al. | 222/135 |
| 7,654,416 | B2 * | 2/2010 | Buining et al. | 222/144 |
| 7,718,435 | B1 * | 5/2010 | Bogen et al. | 436/46 |
| 8,141,596 | B2 * | 3/2012 | Bartholomew et al. | 141/18 |
| 8,196,776 | B2 * | 6/2012 | Doglioni Majer | 222/1 |
| 2004/0059041 | A1 | 3/2004 | McClain | |
| 2006/0169718 | A1 | 8/2006 | Buining et al. | |
| 2006/0175570 | A1 * | 8/2006 | Held et al. | 251/315.03 |
| 2006/0175571 | A1 * | 8/2006 | Held et al. | 251/315.03 |
| 2007/0044863 | A1 * | 3/2007 | Engels et al. | 141/83 |
| 2007/0084520 | A1 * | 4/2007 | Driessen et al. | 141/2 |
| 2008/0212401 | A1 * | 9/2008 | Alessandro | 366/152.1 |
| 2011/0101028 | A1 * | 5/2011 | Chassaing | 222/144 |

FOREIGN PATENT DOCUMENTS

| | | | |
|---|---|---|---|
| EP | 1134186 | A1 | 9/2001 |
| EP | 1492970 | A1 | 1/2005 |
| EP | 1 688 652 | A1 | 8/2006 |
| EP | 1772710 | A1 | 4/2007 |
| EP | 1820568 | A1 | 8/2007 |
| EP | 2135668 | A1 | 12/2009 |
| EP | 2 198 950 | A1 | 6/2010 |
| WO | 2005039747 | A2 | 5/2005 |
| WO | 2005107933 | A1 | 11/2005 |
| WO | 2006106540 | A1 | 10/2006 |
| WO | 2010113008 | A1 | 10/2010 |

OTHER PUBLICATIONS

International Search Report and Written Opinion for corresponding PCT Application No. PCT/EP2012/055511, report dated Sep. 30, 2013.

* cited by examiner

METHOD AND APPARATUS FOR DISPENSING LIQUIDS FROM A PLURALITY OF CARTRIDGES

BACKGROUND

Technical Field

The invention relates to an apparatus for dispensing a plurality of liquids, in particular colorants for paints, comprising a support, such as a turntable or a linear table, defining a plurality of positions, e.g. slots or compartments, and a plurality of containers holding a liquid, mounted on the support at the positions, and provided with a pump and/or a valve for dispensing the liquid from the container.

The invention further relates to a cartridge to be releasably mounted in the apparatus.

Background of the Related Art

US 2006/0169718 relates to a dispenser apparatus including a centrally located vertically mounted column assembly. A plurality of canisters is cantilever mounted to the column assembly. Each canister has a receptacle for holding a fluid and each receptacle includes a corresponding pump for dispensing fluid held therein. The dispenser apparatus also includes a stationary dispensing station having a mechanism for selectively actuating the pump for dispensing fluid held in the receptacle. A mechanism is also provided for engaging a portion of a canister to align a pump corresponding to a receptacle to the stationary dispensing station, wherein the fluid held in the receptacle may be dispensed.

Similar apparatuses are known from WO 2010/113008, WO 2005/107933, WO 2005/039747, EP 800 858, EP 1 134 186, and EP 1 090 679. U.S. Pat. No. 2,094,702 discloses a color mixing machine comprising a plurality of containers mounted on a vertical support.

EP 1 772 710 discloses a metering cap (10) comprising a body (11) and a metering disc (15) rotatably mounted between two surfaces (20, 24) of the body. The metering disc (15) has at least one hole or cavity (18) that can be filled with a unit volume of powder through a first opening (21) in a first angular position of the metering disc. By rotation of this disc by means of a gear wheel (17) solidly attached to a drive shaft (16) and to the metering disc (15), the powder held in the cavity (18) can be discharged through a second opening (23) and an exit channel (22) in a second angular position. The metering cap is intended to be fitted on each of the powder bottles employed in a station for preparing mixtures of powders. In the description (paragraphs [0046] and [0067]) it stated that the metering cap could be used, not only for powders of any grain size but also for more or less pasty substances and even for liquids. EP 1 772 710 provides no information on how this could be effected.

It is an object of the present invention to provide an apparatus for dispensing a plurality of liquids, in particular colorants for paint, that is more operator friendly.

SUMMARY OF THE DISCLOSURE

To this end, in the apparatus described in the preamble of this specification, at least some of the containers form, together with a respective liquid and pump and/or valve, a cartridge, which cartridge is releasably mounted in the apparatus.

Thus, the components of the apparatus that come into contact with a specific liquid, in particular colorants for paints, are integrated to form a closed, swappable module and specific liquids are no longer confined to specific locations in the apparatus.

In an embodiment, at least some of the containers and respective pump and/or valves are unitary, i.e. form a whole such the container and pump and/or valve cannot be taken apart without causing permanent damage to the cartridge.

In another embodiment the pumps are positive displacement pumps, e.g. piston pumps, gear pumps, or nutating pumps.

To reduce or prevent contact between the liquids and surrounding air, it is preferred that at least some of the containers comprise a flexible bag holding the liquid.

In an embodiment, at least some of the cartridges contain a device urging the liquid in the container towards the pump and/or valve, e.g. by a spring, pressurized gas or by squeezing the flexible bag, if present.

In another embodiment, the apparatus comprises a device for measuring, e.g. weighing, the amount of liquid that is being dispensed. Thus, at least part of the accuracy is obtained via weighing and the pumps can be kept relatively simple, which is especially relevant if the cartridge and hence the pump is disposable. Further, verification of the dispensed amounts reduces the risk of so-called miss-tints.

In principle, it is possible to weigh the (paint) can into which the liquids are dispensed. However, as in practice the weight of cans varies considerably, typically filled cans are in a range from 0.5 to 21 kilograms, and cans are often dropped onto the support, it is preferred that the apparatus comprises a weighing device for weighing the support, and thus all cartridges on it, or one or more individual cartridges, e.g. the cartridge from which a liquid is being dispensed.

In another embodiment, one or more of the positions are empty during normal use, i.e. no cartridges are present at these positions. Thus, if one of the cartridges in the apparatus is (almost) depleted, a further cartridge containing the same liquid can be placed in the empty position.

In yet another embodiment, the apparatus comprises a cover positioned over the support and the cartridges, which cover allows access to precisely one position on the support. This enables the dispenser to determine and record the positions of each of the cartridges inserted into the dispenser, without the need for e.g. a barcode or transponder.

To enhance swappability of the cartridges, it is preferred that replacing a cartridge with an identical cartridge merely requires mechanically disengaging the cartridge and subsequently mechanically engaging the replacement cartridge.

The invention also relates to an apparatus as defined in the preamble of this specification, wherein the support is a turntable and the turntable extends vertically or at an angle ($\alpha$) in a range from 0° to 80° with the vertical.

In these configurations, which can also be applied in embodiments not having the swappable cartridge specified above, rotation of the table results in stirring of the contents of the containers. Thus, stirrers are in principle not required or could be replaced with static elements, such as protrusions, e.g. ridges, on the inner wall of the container.

In an embodiment, the angle ($\alpha$) equals arctan(d/1) ±5°, where "d" is the average diameter and "1" is the length of the container.

In another embodiment, no movable, e.g. rotatable, stirrer is present in at least some, preferably all of the containers.

In a further embodiment, the apparatus comprises a controller, in turn provided with or connected to a memory, for operating the support and pumps and/or valves and storing for at least some of the liquids the amounts that are used per unit of time.

In a refinement, the controller is arranged to store the consumption of the liquids in the containers over a prolonged period of time, e.g. spanning the period of installation of at least two consecutive cartridges containing the same (type of) liquid.

Statistics of colorant consumption enable calculating the probability that a cartridge will need to be replaced with a new (full) cartridge in e.g. the coming day or week. Depending of the probability, the apparatus can then generate a message suggesting e.g. inserting a replacement cartridge in the apparatus, thus avoiding having to replace a cartridge during the dispensing of a recipe while a customer is waiting.

Invention further relates to a cartridge to be releasably mounted in an as described above, the cartridge comprising a container holding a liquid and a pump and/or a valve for dispensing the liquid from the container.

The drawings are not necessarily to scale and details, which are not necessary for understanding the present invention, may have been omitted.

DETAILED DESCRIPTION OF THE PRESENTLY PREFERRED EMBODIMENTS

Figure 1:
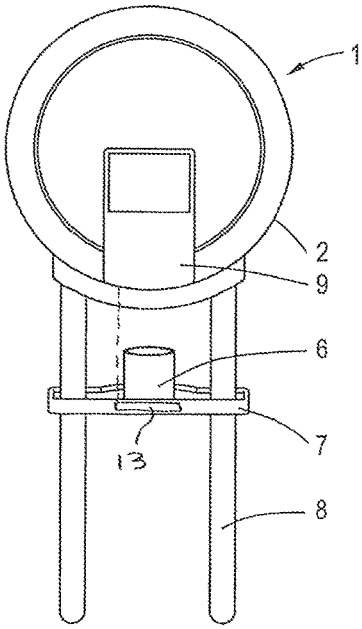
FIGS. 1 and 2 are front and side views of a dispenser according to the present invention.

FIG. 1 shows an example of an apparatus 1 for dispensing a plurality of liquids, such as (components of) paints, paint colorants, hair dyes, shampoos, foundations, and the like. It can be used for dispensing numerous recipes and formulas of the said products and it can be located e.g. at a retailer of decorative paints, a hairdresser, or a spa, respectively.

Figure 2:
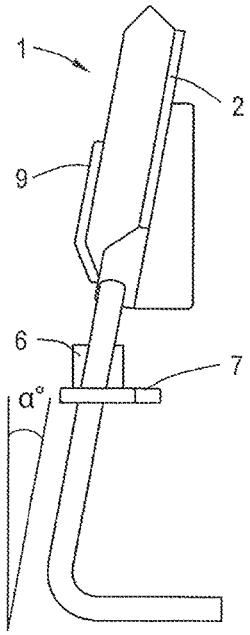
Figure 3:
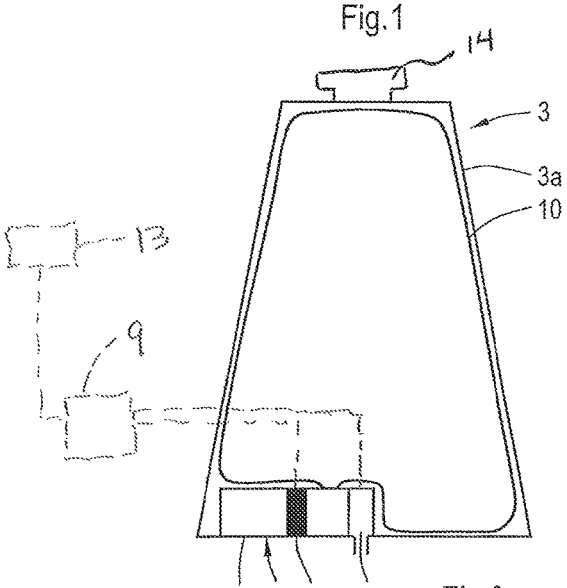
FIG. 3 is a cross-section of a cartridge according to the present invention.

This particular dispensing apparatus 1 is an automated version and includes an inclined turntable 2, with a plurality of cartridges 3 (hidden from view in FIGS. 1 and 2, but shown in FIG. 3) mounted along its circumference. Each cartridge 3 is provided with a pump 4 and a dispense valve 5 (FIG. 3). The turntable 2 can be rotated between discrete positions, e.g. twelve or sixteen positions 2A including a dispensing position, i.e. a position where the pump and valve of the cartridge at the dispense position are operated by means of a central actuator. Fluids are dispensed in a receptacle, in this example a bucket 6 on an adjustable shelf 7.

The apparatus 1 includes a frame or stand 8 and a controller and memory, i.c. a computer 9, for entering and storing information, such as customer data and recipes, and generating instructions for driving the turntable 2, pumps and valves. It is noted that a device 13 for measuring the amount of liquid that is being dispensed may be provided. Device 13 may also be a weighing device for weighing the support 3 or one or more individual cartridges 3.

Further information regarding suitable turntables and procedures for driving the various components, are disclosed in, for instance, European patent applications EP 800 858, EP 1 492 970, EP 1 688 652, and EP 2 198 950.

As mentioned, FIG. 3 shows a cartridge 3 comprising a housing 3*a,* flexible bag 10 holding a liquid, e.g. a colorant for paint, a piston pump 4 and a valve 5. These components are integrated to form a disposable (one-way) unit. In this example the pump comprises a cylinder 11 and a magnetic piston 12, that can be reciprocated at relatively high frequencies, e.g. 1 Hz, by a driving magnet at the dispense position It is noted that a device 14 for urging the liquid in the container 10 towards the pump 4 and/or the valve 5 may be provided.

Figure 4:
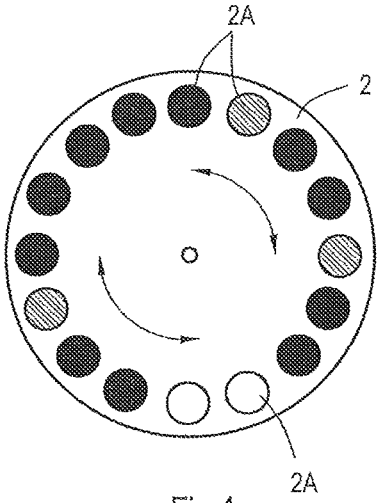
FIG. 4 a schematic depiction of a support as used in the dispenser shown in FIGS. 1 and 2.

In an example, illustrated in FIG. 4, the apparatus is intended for use with Y colorants and comprises X positions, within X>Y. During initial use, Y slots are filled with colorant cartridges and X-Y slots remain empty. In the event that a cartridge reaches a critical volume level, the controller warns the operator to place a new extra cartridge containing the same liquid in an empty slot.

From an operators perspective, it is best if the controller recommends which cartridges need to be added to the system only once a day, e.g. in the morning when the system is started up. A preferred approach is to use historic colorant consumption statistics to calculate the probability that a cartridge must be replaced that day. This implies that some cartridges may still have significant amounts of colorant in them, while others (that are used e.g. only once a week) will be completely depleted before the system recommends replacement.

The general purpose of the empty slots is to avoid the need to replace a cartridge during a dispense. The system is preferably equipped with sufficient empty slots such that it rarely occurs that the system runs out of empty slots. Using computer simulation of historic consumption, it can be estimated how many empty slots are needed for a particular customer to have sufficient empty slots. This estimate will become more accurate over time.

In a refinement, the last empty slot is reserved for colorant cartridges that are used frequently, i.e. not 'given away' to infrequently used colorant cartridges.

As a matter of course, this disclosure is not restricted to the above-disclosed embodiments, which may be varied in different manners within the scope of the claims.

What is claimed is:

1. An apparatus for dispensing a plurality of liquids, the apparatus comprising:

a support comprising a plurality of cartridge positions;

a plurality of cartridges comprising a first cartridge, respective cartridges comprising a container to hold a liquid, and at least one of a pump and a dispense valve to dispense the liquid, the plurality of cartridges respectively releasably mounted in one of the plurality of cartridge positions comprising a first position in which the first cartridge is disposed, and the support having at least one empty cartridge position during operation comprising a second position; and a controller connected to a memory and to at least one of the pump and the dispense valve of the first cartridge, the controller and memory:

operating the support and pump and/or valve of the first cartridge;

storing data indicative of an amount of liquid used per unit of time for the first cartridge;

calculating a probability that the first cartridge will need to be replaced during a coming time period; and generating a message suggesting replacement of the first cartridge by placing a replacement second cartridge containing the same type of liquid as the first cartridge in the second position.

2. The apparatus of claim 1, the first cartridge comprising a unitary construction with the respective pump and/or valve.

3. The apparatus of claim 1, wherein the pump is a positive displacement pump.

4. The apparatus of claim 1, the plurality of cartridges comprising a flexible bag-like container to hold the liquid.

5. The apparatus of claim 1, comprising a device for measuring the amount of liquid that is being dispensed.

6. The apparatus of claim 5, the device for measuring comprising a weighing device for weighing the amount of liquid that is being dispensed.

7. The apparatus of claim 6, the weighing device weighing one or more of:

the support and the plurality of cartridges disposed thereon, and one or more the respective plurality of cartridges.

8. The apparatus of claim 1, the controller generating the message suggesting replacement of first cartridge when the controller calculates that the first cartridge is almost depleted of liquid.

9. The apparatus of claim 1, the support and plurality of cartridges configured such that replacing the first cartridges with the second cartridge containing the same type of liquid comprises mechanically mounting a housing of the second cartridge in the second position of the support, and mechanically disengaging a housing of the first cartridge from the first position.

10. The apparatus of claim 1, comprising a central actuator to operate the pump and/or valve in the first cartridge disposed at a dispense position.

11. The apparatus of claim 1, the controller and the memory storing data indicative of consumption of the liquid in the first cartridge over a period of time between installation of the first cartridge and installation of the second cartridge containing the same liquid, resulting in replacing the first cartridge after consumption of the liquid of the first cartridge.

12. The apparatus of claim 1, the first cartridge comprising a pressurized gas urging the liquid in the container towards the pump and/or valve.

13. The apparatus of claim 1, the first cartridge comprising a biasing device biasing the liquid in the container towards the pump and/or valve.

14. The apparatus of claim 1, the support comprising a plurality of empty cartridge positions during operation.

15. The apparatus of claim 1, comprising a cover disposed over the support and at least a portion of the plurality of cartridges, the cover allowing access to a single cartridge position on the support.

16. The apparatus of claim 15, the controller identifying the cartridge position of a cartridge inserted at the single cartridge position on the support based on the access to the single cartridge position on the support.

17. The apparatus of claim 1, the support comprising a turntable that extends vertically or extends at an angle (a) in a range from 0° to 80° with the vertical.

18. The apparatus of claim 17, the turntable configured to rotate, resulting in stirring of liquid in the plurality of cartridges.

19. The apparatus of claim 1, comprising an adjustable shelf to accommodate a receptacle into which the liquid is dispensed.

20. The apparatus of claim 1, the controller comprising a computer to enter one or more of customer data and recipes.

* * * * *